US005596830A

United States Patent [19]

Morgan

[11] Patent Number: 5,596,830

[45] Date of Patent: Jan. 28, 1997

[54] FIREARM REST

[76] Inventor: James M. Morgan, 109 Crestmont Dr., Hendersonville, Tenn. 37075

[21] Appl. No.: 380,302

[22] Filed: Jan. 30, 1995

[51] Int. Cl.[6] ..... F41A 23/02

[52] U.S. Cl. ..... 42/94

[58] Field of Search ..... 42/94; 89/37.04

[56] References Cited

U.S. PATENT DOCUMENTS

| | | | |
|---|---|---|---|
| 454,300 | 6/1891 | Sproul | 42/94 |
| 879,052 | 2/1908 | Jeranek | 42/94 |
| 4,007,554 | 2/1977 | Helmstadter | 42/94 |
| 4,893,427 | 1/1990 | Davidson | 42/94 |
| 4,937,965 | 7/1990 | Narvacz | 42/94 |
| 4,998,944 | 3/1991 | Lund | 42/94 |
| 5,081,782 | 1/1992 | Wright | 42/94 |
| 5,257,947 | 11/1993 | Scheer et al. | 439/567 |
| 5,345,706 | 9/1994 | Brown | 42/94 |
| 5,375,337 | 12/1994 | Butler | 33/506 |

*Primary Examiner*—Michael J. Carone
*Assistant Examiner*—Christopher K. Montgomery
*Attorney, Agent, or Firm*—Rick R. Wascher; Laura K. Thomas; Wascher & Thomas

[57] ABSTRACT

A firearm rest comprising a base and a rifle seat component. The rifle seat component is attached to the base by a cooperating pin connection or formed integral therewith. The base includes at least one channel capable of receiving a tie down member such as a rope or other article for secure attachment to a vertical support surface. The base also includes a platform having a plurality of pin receiving bores. The seat component includes a channel which includes an optional cushion for receiving a rifle. The seat includes upwardly projecting walls and a pin extending substantially perpendicular from the walls. The pin or pins are configured to be received within the bores of the base.

14 Claims, 4 Drawing Sheets

FIREARM REST

BACKGROUND OF THE INVENTION

1. Field of the Invention

The present invention relates generally to rifle rests and supports for supporting a firearm while shooting, but more particularly to rifle rests and supports capable of being positioned on a vertical support surface.

2. Description of the Related Art

The art to which the present invention relates includes a variety of rests and supports for steadying rifles and pistols (hereinafter simply "firearm" or "firearms" depending upon the context) when shooting. The rifle rests and supports comprising the art to which the invention relates includes benches, shooting bags, chairs with firearm supporting frame segments, as well as vises, pillows, and shooting blocks on which one supports a firearm when shooting. All such devices provide the shooter with a means of steadying the firearm to provide a greater degree of accuracy for each shot. Some rests incorporate an anchoring means enabling the firearm to be rigidly bolted or clamped into a shooting position so as to provide minimal variance between the sight line on each successive shot. All such devices are known to be utilized on a horizontal plane or surface.

A common drawback associated with all of the known devices and apparatuses for supporting a firearm is the inability of such devices to support the firearm from a vertical surface such as a tree, door frame, telephone pole, car door edge, or virtually any vertical support surface. For example, firearm vices, shooting bags, bipods and tripods, are all designed to be positioned upon a horizonal plane such as a tabletop or other horizontal support surface.

The tactical weaponry of law enforcement and military personnel typically incorporate a bipod or tripod arrangement. The bipod or tripod serves as a two or three point contact, respectively, to prevent or minimize wavering of the rifle barrel when shooting. The two or three point contact enables the shooter to support the firearm with one hand, and shoulder in the case of a rifle, without the necessity of having the free hand support the forend portion of the firearm.

The bipod or tripod arrangement, therefore, allows the sniper to position himself in a strategic location and steady the firearm when making the shot, but limits his versatility and effectiveness due to his inability to use the bipod or tripod on vertical support surfaces. Furthermore, because law enforcement and military snipers must often position themselves in awkward and obscure cover in order to prevent detection, the sniper may not have the opportunity to select a horizontal surface on which to lay and rest the rifle, because of the terrain and/or foliage to his front.

Accordingly, in a variety of combat situations where it is not practical or safe for the shooter to lie down on or utilize a horizontal surface and where there is no convenient horizontal support on which to rest the firearm, the shooter must support the firearm, such as the rifle, at the forend by positioning his free hand (the hand not being utilized to pull the trigger and fire the weapon) on the forend of the stock or barrel of the rifle. In short range shooting situations this two hand manner of aiming is not particularly troublesome because a slight amount of wavering or misalignment of the sights or rifle scope will not produce a significant or appreciable degree of inaccuracy. The problem is compounded, however, when the shooter desires to shoot long range targets and any misalignment of the sights or wavering of the weapon would cause the "off target" projection of the bullet to be exaggerated.

For example, in military combat situations where a specially trained military sniper uses a sniper rifle, such as a Barrett 50 caliber semiautomatic rifle which is known to be one of the finest of its kind in the world, to shoot a target at a significant range often more than 1,000 yards, the shooter must be extremely still because any wavering however slight will cause the shooter to miss the target entirely. For example, when a rifleman is steadying him or herself and aiming through either open sights or a telescopic sight and preparing to make the shot, the individual's heartbeat will often provide enough wavering of the rifle to cause an inaccurate shot. In this fashion, the fewer contact points of the shooter on the weapon provides greater accuracy.

Accordingly, until now a multi-functional, stable, easily assembled and mounted firearm rest for supporting a firearm on a vertical surface has not been invented.

SUMMARY OF THE INVENTION

The present invention includes a base component and a rifle seat component which is attachable and detachable from the base. The base typically includes at least one channel capable of receiving a tie or other fastener such as a rope, tape, wire, nail, or other suitable means of anchoring the base to a vertical support surface. In the preferred embodiment, the base incorporates a pair of opposed channels for greater stability. The base component typically also includes a plurality of bores which form a component of a cooperating pin connection between the rifle seat component.

The rifle seat component typically includes a pocket for resting the rifle or firearm. The seat component therefore may resemble a U, inverted C, or the letter Y when viewed from the side. In the preferred embodiment, the rifle seat includes the other component of the cooperating pin attachment mechanism. The pins, which are received in the pin receiving bores of the base, extend perpendicularly from a side of the rifle seat. Thus, the pins are preferably positioned perpendicular to the longitudinal axis of the rifle rest channel.

The cooperating pin connection typically includes at least one cylindrical pin, but preferably a pair of pins to provide greater stability of the seat with respect to the base when it is attached thereto. The pin(s) may include a pronged end such that the prongs of the pin can deflect when they are inserted into the pin receiving bores of the base. The pronged ends of the pins also preferably include a raised projection at the tip of each fork of each pin. If the pins are slightly longer than the depth of the bores on the base, the raised projections pass through the bores and engage the rear surface or an internal pocket in the bores of the base. That is, when the pins are inserted into the bores, the projection causes the forked ends to deflect and decrease the projectional diameter of the pins enabling the pins to be inserted into the bores in a relatively snug fashion. When the projections pass through the extent of the bores, they again flex outwardly and frictionally grip a surface of the base. Disconnecting the rifle seat from the base is accomplished by pulling the rifle seat away from the base to a sufficient degree to overcome the frictional retaining force associated with the pronged pins, but more particularly the frictional contact between the projections and the surface of the base.

In the preferred embodiment of the rifle seat component, a pad is placed in the rifle retaining channel. The pad is preferably constructed of a soft non-scratch, non-marring material in order to prevent scratching or marring the rifle when it is placed within the channel the rifle seat. The seat and base may be formed from a plastic or metal that does not mar or scratch the finish of the rifle. Further, the seat can be preferably sized slightly smaller than the dimension of the portion of the rifle which is to be received in the channel. In this way, the rifle may be press fitted down into the channel enabling the cushion to resiliently deform around the rifle to provide a snug frictional fit. This snug frictional fit is believed to further enable the shooter to benefit from the increased stability of the overall system.

Thus, the present invention may be summarized in a variety of ways, one of which is the following: a firearm rest comprising: a base component and a firearm seat component attachable to and removable from the base; the seat component further comprises at least one wall and a crossmember extending from and substantially perpendicular to the at least one wall to form a firearm receiving portion, and at least one pin extending from and substantially perpendicular to the at least one wall; the base component further comprising at least one fastener channel for receiving a fastener, a platform portion parallel and adjacent to the at least one fastener channel, at least one bore for receiving the at least one pin enabling the seat component to be removably attached to the base component.

The firearm rest also includes at least one wall includes a pair of spaced apart walls, at least one pin and at least one bore includes a plurality of pins and a plurality of bores for receiving the plurality of pins providing enhanced stability of the seat with respect to the base, at least one fastener channel includes a pair of spaced apart channels positioned adjacent to and parallel with the platform.

The seat component may also include a pad to cushion the firearm receiving portion in order to prevent scratching and marring of the firearm, and the at least one pin may further include a bifurcated portion for improved the frictional contact between the at least one pin and the at least one pin receiving bore.

The rest of the present invention may also be summarized as follows: a base component having channel means for receiving a fastener configured to attach the base to a vertical support surface; a firearm seat component configured to receive a portion of the firearm while shooting; and pin means for removably attaching the seat component to the base component.

The pin means may further include at least one pin and a plurality bores arranged to enable the firearm seat to be removably attached to the base component in a variety of user selected positions. The firearm seat component may further include a pair of spaced apart walls projecting substantially perpendicularly to and integral with a crossmember, and a firearm receiving channel formed by the walls and the crossmember and a pad configured to be placed within the firearm receiving channel to prevent scratching and marring of the portion of the firearm received therein.

yet another way of summarizing the invention is: a firearm rest configured for attachment to a vertical support surface, comprising: a base component having a pair of spaced apart channels configured for receiving a fastener enabling the base component to be removably attached to the vertical support surface; a firearm seat component having a pair of spaced apart walls forming a firearm receiving channel; and cooperating pin and bore attachment means for removably attaching the base component to the seat component.

A platform is preferably interpositioned between the spaced apart channels of the base component. The bore component of the cooperating pin and bore attachment means may further include a plurality of bores formed in the base component and arranged to enable the firearm seat to be removably attached to the base component in a variety of user selected positions.

An object of the present invention is to provide a rifle rest capable of being mounted to a vertical support.

An object of the present invention is to provide a rifle rest having a base component which is easily attached to a vertical support and a rifle seat which is easily attached and detached from the base.

An object of the present invention is to provide a rifle rest capable of frictionally grasping the firearm placed within a firearm receiving channel of the seat component of the rifle rest.

Yet another object of the present invention is to provide a cooperating pin connection between the base component and seat component of the rifle rest system.

An advantage of the present invention is to provide a forked pin component for use in a cooperating pin connection between a base and a rifle seat component.

Another advantage of the present invention is to provide a rifle rest capable of securing a firearm in steady relationship to a shooter when the rifle rest is attached to a vertical support surface.

These and other objects, features and advantages of the present invention shall become apparent after consideration of the description, drawings and claims set forth below. All such objects, features, and advantages are believed to be within the scope of the present invention even though not specifically enumerated and set forth herein.

DETAILED DESCRIPTION OF THE PREFERRED EMBODIMENT(S)

Figures 1, 2:
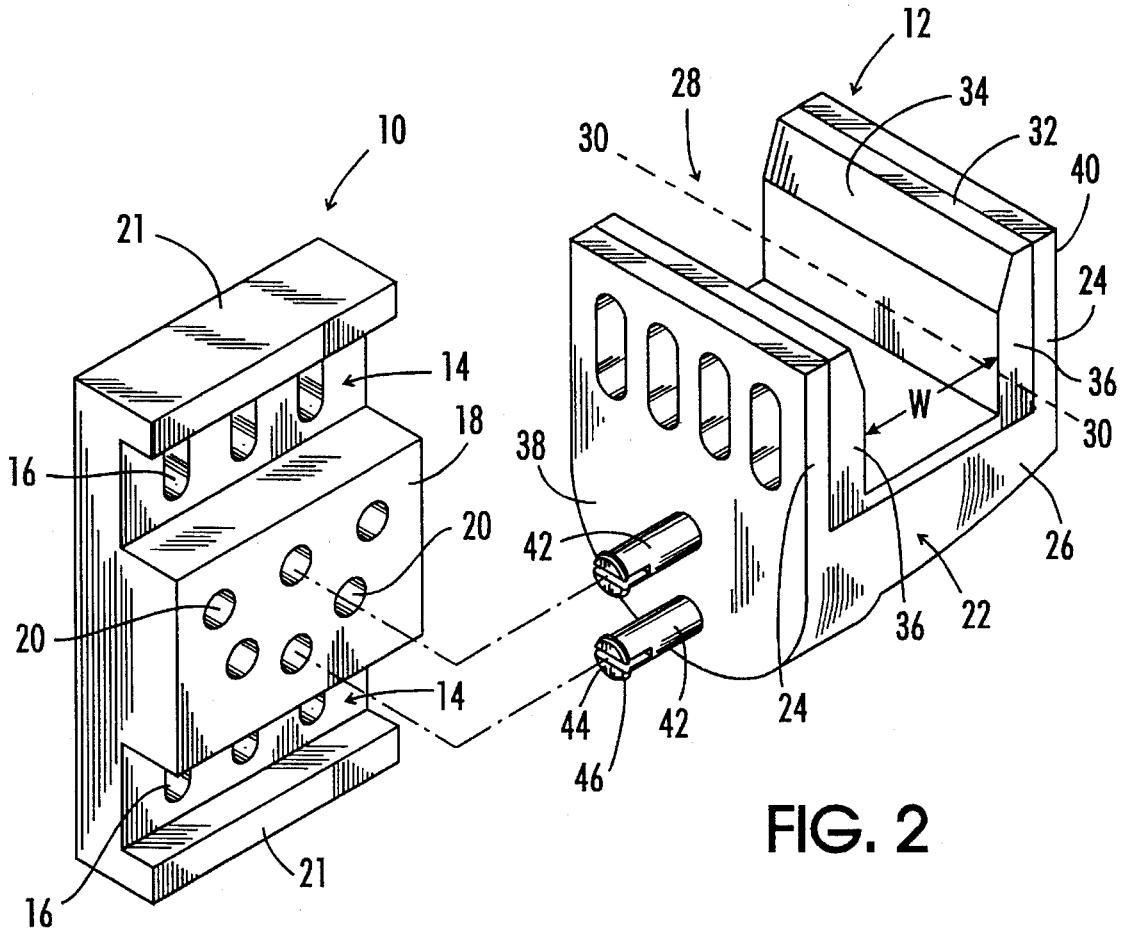
FIG. 1 is an elevated perspective view of the base component of the present invention.
FIG. 2 is an elevated perspective view of the firearm seat component of the present invention which is capable of being attached and detached from the base component of FIG. 1.
Figure 3:
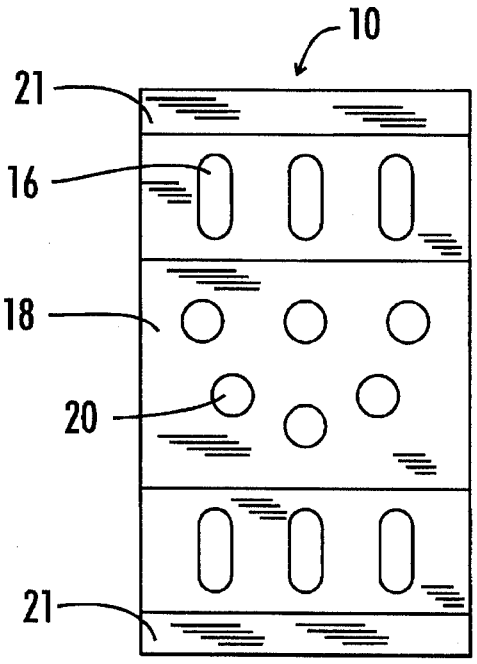
FIG. 3 is a front plan view of the base component shown in FIG. 1.

With reference to FIGS. 1 and 2, an embodiment of the present invention is shown as generally including a base component 10 and a firearm seat component 12. The base component is preferably constructed of a metal or high strength synthetic material including plastics or polymers. A high strength synthetic material is preferred because of its inherent strength to weight ratio.

A preferred embodiment of the base 10 incorporates a pair of spaced apart channels 14. Channels 14 are provided to enable a tie down component (not shown) such as a rope, tape, wire, or other suitable means of anchoring the base to a vertical support surface to be easily accomplished. Within each of the channels 14 is a series of slots 16. Slots 16 are optional but preferred because they enable the user to anchor the base to a vertical support surface by way of rivets, nails, pegs, or other suitable fastening means.

For example, a shooter desiring to anchor the base to a vertical support surface, and depending upon the surface selected, may decide that a spike or nail driven through any two of the slots 16 and into a vertical support surface such as a tree would be easier than anchoring the device to the tree by way of rope, tape, or tie passing through and within the channels 14.

Figure 4:
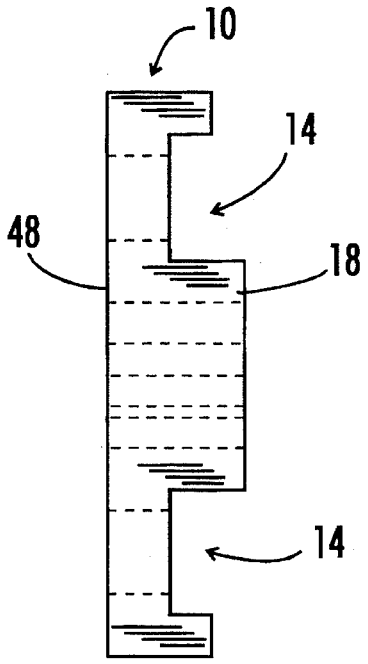
FIG. 4 is a side view of the base component shown in FIG. 3.

In a preferred embodiment, a raised mounting platform 18 is positioned between the channels 14. The platform 18 preferably extends beyond the height of the channel sides 20 so as to prevent a binding effect between the base 10 and seat 12 when they are joined together. A plurality of pin receiving bores 20 are formed in the platform 18. The pin receiving bores are a component of the cooperating pin connection mechanism as will be described more thoroughly hereinbelow. The bores may have an extent which passes through the entire width of the base (see FIG. 4) or they may terminate at a predetermined depth within the platform component of the base.

With respect to FIG. 2, the rifle seat 12 has the general characteristics of an inverted C, U or letter Y shape. Seat 12 has a front and a back which are substantially identical in the preferred embodiments. Accordingly, when viewed from the front 22 (which has been selected arbitrarily as opposed to the back) the seat 12 has spaced apart parallel upwardly extending sidewalls 24 which are in communication with one another by a cross member 26. The cross member 26 and the sides 24 are preferably formed from a rigid inflexible material such as a metal or high strength plastic as mentioned above. The relationship and arrangement of the walls 24 with the cross member 26 forms a firearm channel 28. The firearm channel has a longitudinal axis 30 which is parallel to the sides 24.

Cushion 32 configured to conform to the interior of the channel 28 and abut the sidewalls 24 and cross member 26 is positioned within the channel 28. The cushion 32 may have beveled surfaces 34 which enable the shooter to insert the forend portion of a firearm, such as a sniper rifle, into the cushion with ease and without binding or causing the cushion to have a tendency to pull away from the sidewalls 24. The bevels therefore enable easy entry and extraction of the rifle from the channel 28. Of course, in the preferred embodiments, the width W of the channel formed by the upwardly extending portions 36 of the cushion 32 is slightly smaller than the width of the firearm. In this fashion, the firearm can be forcibly pressed into the channel 28 and a frictional contact between the cushion 32 and the rifle is then established to enable the rifle to be secured within the channel and free of wavering movement. Therefore, the cushion is preferably comprised of a resilient material capable of deflecting and deforming in shape but retaining its shape when forces such as a rifle pressed within the channel is removed.

Walls 24 of the rifle seat 12 have opposing side surfaces 38 and 40. Surface 38, which in alternate embodiments may be surface 40, has at least one pin 42 (the figure shows two pins) extending perpendicularly therefrom. In the preferred embodiments, the length of the pin 42 (the distance the pin extends from the surface 38 (or 40)) is sized to correspond to the depth of the pin receiving bores 20.

In the preferred embodiment, the pin 42 has a pronged free end portion 44 which includes a projection 46. The diametrical projection of the free end 44 measured at the projection 46 is slightly larger than the diameter of the pin receiving bores 20. In this fashion, when the user wishes to mount the rifle seat to the base component, he merely aligns the pin or pins 42 with a cooperating set of bores 20 and inserts the pins into the bores. The pronged ends 44 deflect thereby decreasing their diameter enabling the pins to be fully inserted into the bores. After insertion, the pronged ends 44 are preferably allowed to flex back into their normal position. In this fashion, if the pins and bores are sized such that the pins are allowed to pass through the bores 20 and entirely through the platform component 18, the pronged ends 44 deflect outwardly to their normal position and enable the projections to apply a frictional force to the back surface 48 of the base (see FIG. 4). In this fashion, the rifle seat 12 is prevented from inadvertent withdrawal from the base 10.

Figure 5:
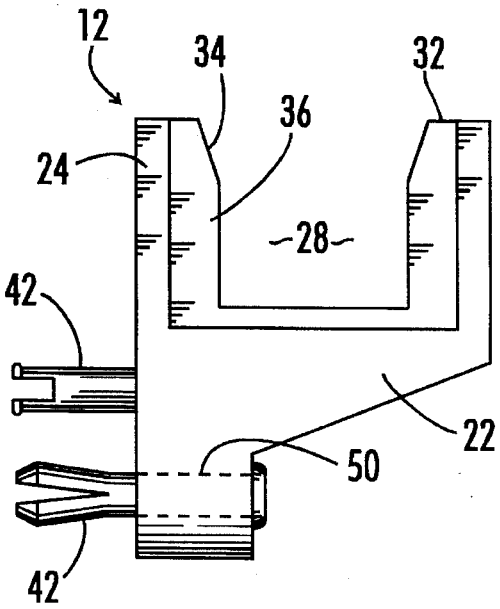
FIG. 5 is a front view of the firearm seat component shown in FIG. 2.
Figure 6:
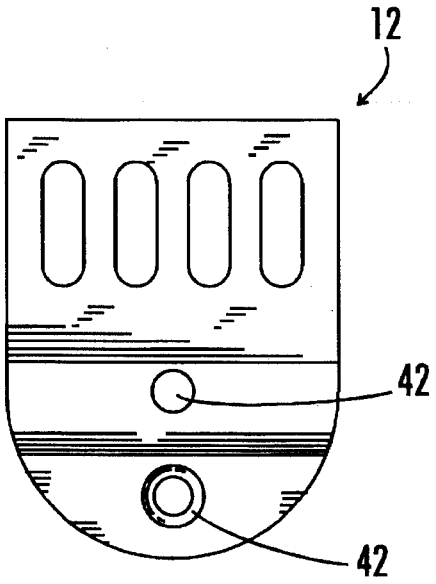
FIG. 6 is a side view of the rifle seat component shown in FIG. 5.
Figure 7:
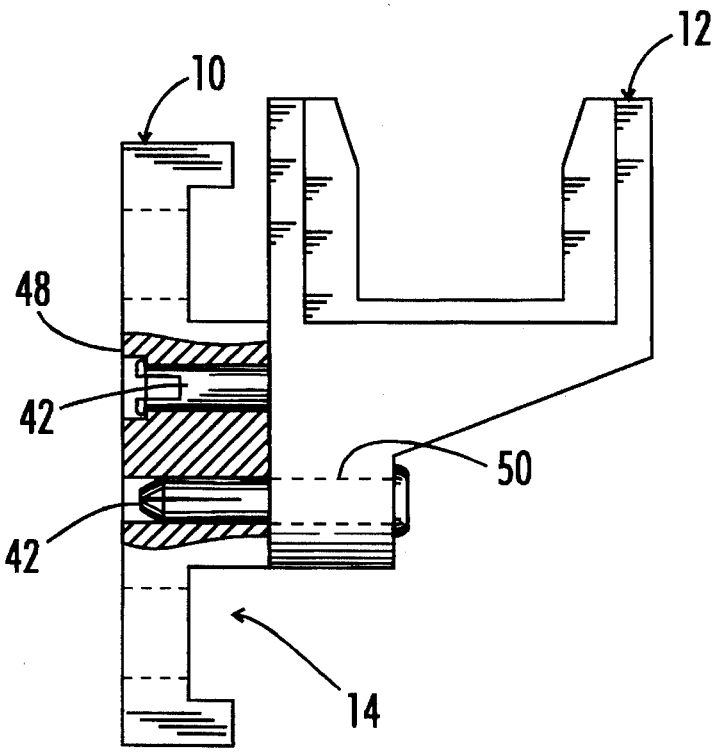
FIG. 7 is a partial cross-sectional view of an embodiment of the present invention.

With reference to FIGS. 3 through 6, the base component 10 and seat component 12 are shown in various views and the like structure is numbered in accordance with FIGS. 1 and 2. With reference to FIG. 5, however, alternate embodiments of the pins 42 are shown. The alternate embodiments illustrated are merely exemplary and are indicative of the numerous configurations which may be incorporated. In yet another embodiment, as illustrated in FIG. 5, the pin 42 may be a separate component which is capable of being inserted through a pin receiving bore 50 (shown by the dashed lines of FIG. 5) and then into the base 10 in much the same manner as described above with the preferred embodiment. It is important to note that the pin connection may be of any suitable configuration, removable or non-removable, flexible or nonflexible, forked or non-forked, and may or may not include a projection depending upon the embodiment, styling and inherent manufacturing concerns. The manner in which the pin attachment mechanism can be modified is therefore dependent upon the user discretion. With reference to FIG. 7, the orientation of the pins 42 are illustrated in two preferred relationships with respect to the base 10 and seat 12.

Figure 8:
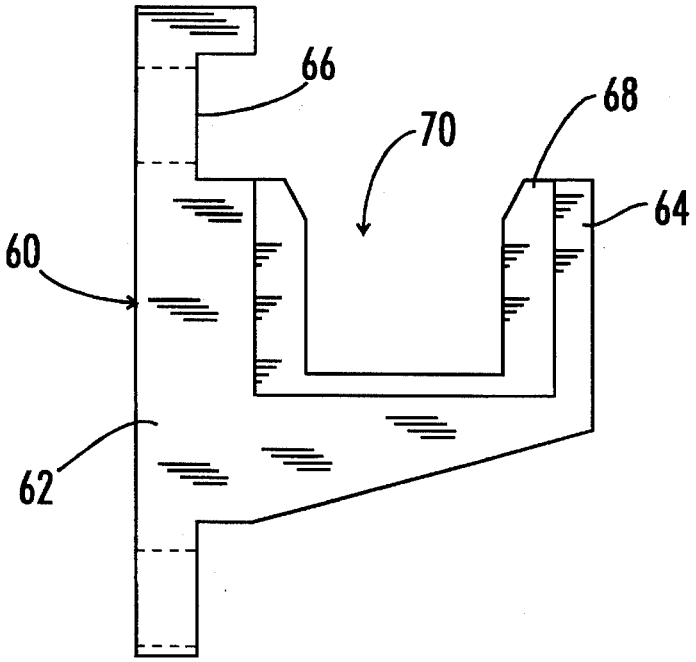
FIG. 8 is a side view of an alternate embodiment of the present invention.
Figure 9:
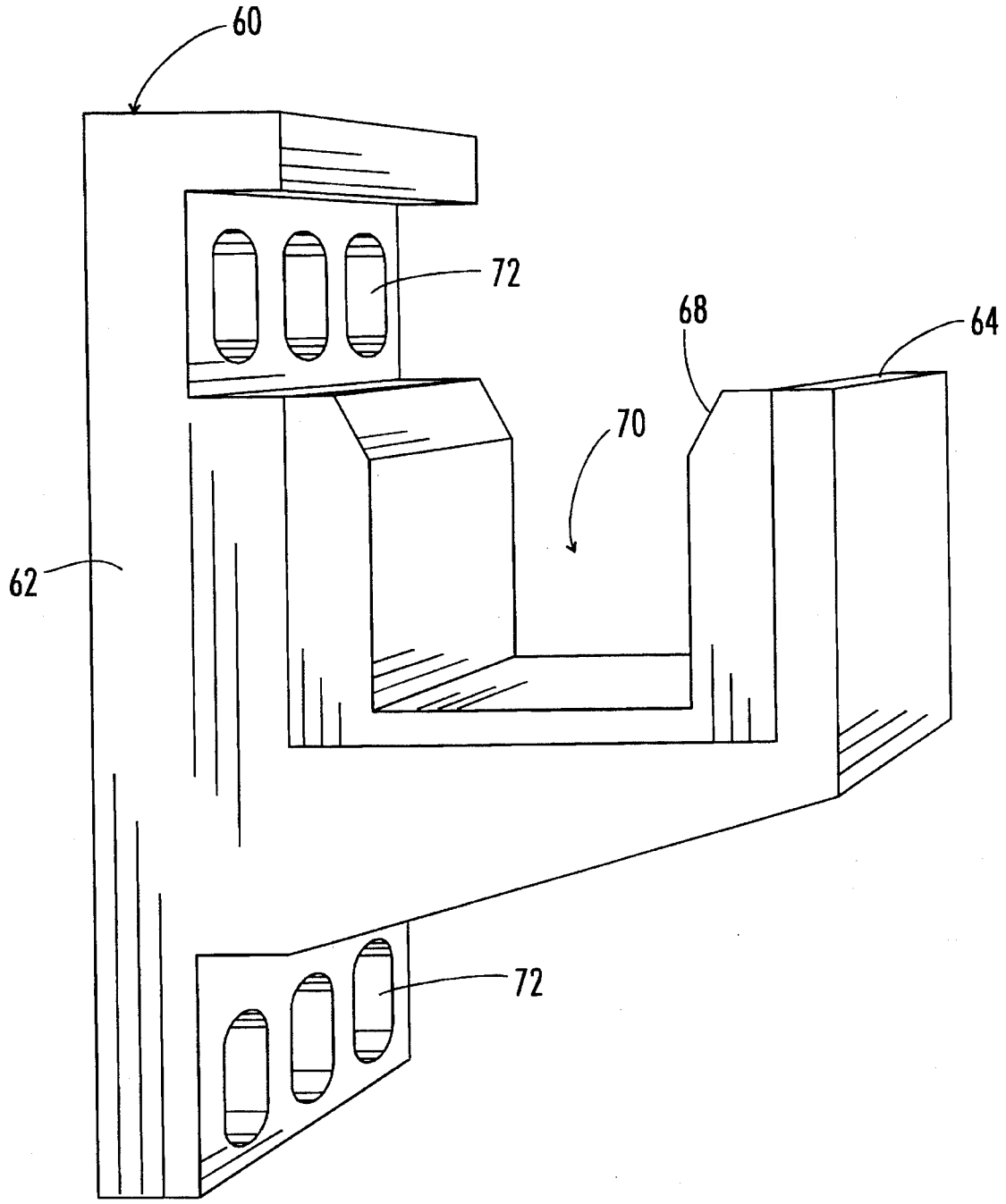
FIG. 9 is an elevated perspective view of the embodiment shown in FIG. 8.

With reference to FIGS. 8 and 9, an alternate one piece embodiment of the present invention is illustrated and designated generally by the reference numeral 60. Embodiment 60 includes a base component 62 and a seat component 64 in combination. Base 62 includes a channel 66 capable of accommodating a tie down (not shown) described above with respect to the other embodiments of the invention. Seat component 64 includes a rifle seat pad 68 which surrounds the rifle seat pocket 70. Apertures 72 are provided as additional means of facilitating attachment of the invention to an upright support structure when in use. Apertures 72 are also provided as an attempt to minimize the weight of the embodiment of the invention by illustrating that a portion of the structural material has been removed.

These and other embodiments of the present invention shall become apparent after consideration of the specification and claims, including the drawings, contained herein. All such embodiments and equivalents are believed to be part of the present invention whose only limitation is the scope of the appended claims.

What is claimed is:

1. An apparatus for supporting a firearm relative to a vertical support surface attached to the ground, comprising:

a base portion and a firearm seat portion;

the seat portion comprising a pair of spaced apart substantially parallel walls merging with a crossmember extending from and substantially perpendicular to the spaced apart walls to form a firearm receiving portion having a substantially upwardly projecting unitary U-shaped configuration;

the base portion comprising at least one fastener channel for receiving a fastener;

at least one pin extending from and substantially perpendicular to the spaced apart substantially parallel walls of the seat component; and a plurality of bores formed in the base component each of which is configured to receive the at least once pin;

wherein the at least one pin is insertable into the plurality of bores in the base portion enabling the seat component to be removably attached to the base component.

2. The firearm rest of claim 1, wherein:

the at least one pin includes a plurality of pins insertable into a plurality of cooperating bores in the base.

3. The firearm rest of claim 1, such that:

the at least one fastener channel includes a pair of spaced apart channels positioned adjacent to and parallel with a platform portion.

4. The firearm rest of claim 1, further including:

a pad positioned within the firearm receiving portion and configured to frictionally engage the firearm and to prevent scratching and marring of the firearm.

5. The firearm rest of claim 1, such that the at least one pin further includes:

a bifurcated portion for improved frictional contact between the at least one pin and at least one bore of the plurality or bores.

6. A rest for supporting a firearm relative to a vertical support surface attached to the ground, comprising:

a base component having channel means for receiving a fastener configured to attach the base to the vertical support surface;

a pair of spaced apart walls projecting substantially perpendicularly to and merging with a crossmember to form a unitary firearm seat component having a substantially rigid U-shaped configuration to receive a portion of the firearm while shooting; and at least one pin insertable into any of a plurality of pin receiving bores arranged to enable the firearm seat to be attached to the base component in a variety of user selected positions.

7. The firearm rest of claim 6, wherein the seat portion and the base portion are a single component and the at least one pin engages the vertical support surface.

8. The firearm rest of claim 6, further including:

a pad configured to be placed within the firearm seat component and having a pair of upwardly extending portions to form a pad channel for receiving a firearm and configured to enable the pad to frictionally engage a firearm.

9. The firearm rest of claim 8, such that the at least one pin further includes:

a bifurcated portion for improved frictional contact between the at least one pin and at least one bore of the plurality of bores.

10. A firearm rest configured for attachment to a vertical support surface extending upward from the ground, comprising:

a base component having a pair of spaced apart channels configured for receiving a fastener enabling the base component to be removably attached to the vertical support surface;

a firearm seat component having a pair of spaced apart walls projecting substantially perpendicularly to and merging with a crossmember forming a rigid unitary firearm receiving channel having a substantially U-shaped configuration to receive a portion of the firearm; and at least one pin extending from one of the spaced apart walls of the seat component, the at least one pin being insertable into any of a plurality of bores formed in the base component for receiving the at least one pin enabling the seat component to be attached to the base component in a plurality of positions.

11. The firearm rest of claim 10, further including:

a platform interpositioned between the spaced apart channels of the base component.

12. The firearm rest of claim 10, further including:

a pad configured to be placed within the firearm receiving channel to frictionally engage the firearm and to prevent scratching and marring of the portion of the firearm received therein.

13. The firearm rest of claim 10, wherein the seat portion and the base portion are a single component and the at least one pin engages the vertical surface.

14. The firearm rest of claim 10, further including:

a pad configured to be placed within the firearm receiving channel and having a pair of upwardly extending portions to form a pad channel for receiving a firearm and configured to enable the pad to frictionally engage a firearm.

* * * * *